US009429316B2

(12) United States Patent
Weissman et al.

(10) Patent No.: US 9,429,316 B2
(45) Date of Patent: Aug. 30, 2016

(54) BURNER ARRANGEMENT AND BURNER ASSEMBLY

(75) Inventors: Gunnar Weissman, Espoo (FI); Jukka Vuorio, Helsinki (FI); Mikael Jåfs, Espoo (FI)

(73) Assignee: Outotec Oyj, Espoo (FI)

( * ) Notice: Subject to any disclaimer, the term of this patent is extended or adjusted under 35 U.S.C. 154(b) by 368 days.

(21) Appl. No.: 14/122,586

(22) PCT Filed: May 31, 2011

(86) PCT No.: PCT/FI2011/050502
§ 371 (c)(1),
(2), (4) Date: Nov. 26, 2013

(87) PCT Pub. No.: WO2012/164142
PCT Pub. Date: Dec. 6, 2012

(65) Prior Publication Data
US 2014/0099587 A1 Apr. 10, 2014

(51) Int. Cl.

| | |
|---|---|
| ***F23D 14/78*** | (2006.01) |
| ***F27B 3/20*** | (2006.01) |
| ***F27B 21/06*** | (2006.01) |
| ***F27D 99/00*** | (2010.01) |

(52) U.S. Cl.
CPC ..... *F23D 14/78* (2013.01); *F27B 3/205* (2013.01); *F27B 21/06* (2013.01); *F27D 99/0033* (2013.01)

(58) Field of Classification Search
CPC ..... F23D 14/78
USPC ..... 431/8, 173, 207; 432/173
See application file for complete search history.

(56) References Cited

U.S. PATENT DOCUMENTS

| | | | | |
|---|---|---|---|---|
| 1,163,650 | A | 12/1915 | Fogler | |
| 3,615,249 | A * | 10/1971 | Martois | F23G 7/065 110/214 |
| 5,149,261 | A | 9/1992 | Suwa et al. | |
| 6,190,158 | B1 * | 2/2001 | Legiret | F23D 14/22 431/12 |
| 6,238,206 | B1 * | 5/2001 | Cummings, III | F23D 14/24 431/10 |
| 6,372,010 | B1 | 4/2002 | Shver et al. | |
| 6,422,858 | B1 * | 7/2002 | Chung | F23C 6/047 431/10 |
| 6,461,145 | B1 * | 10/2002 | Giraud | F23D 14/22 431/10 |
| 6,614,831 | B2 | 9/2003 | Shver | |

(Continued)

FOREIGN PATENT DOCUMENTS

| | | |
|---|---|---|
| GB | 2280501 A | 2/1995 |
| WO | 98/14741 A1 | 4/1998 |

(Continued)

OTHER PUBLICATIONS

International Search Report, PCT International App. No. PCT/FI2011/050502, filed May 31, 2011, Outotec Oyj, 4 pgs.

*Primary Examiner* — Avinash Savani
(74) *Attorney, Agent, or Firm* — Chernoff, Vilhauer & McClung & Stenzel, LLP

(57) ABSTRACT

The invention relates to a burner arrangement comprising a fluid cooled copper block. Further, the invention relates to a burner assembly, a duct element, a gas circulating duct, and a metallurgical furnace comprising said burner arrangement. The burner arrangement (B) comprises a fluid cooled copper block (3) including a cooling conduit (4) for circulation of the cooling fluid, a first end (5) to which the burner unit (1) is releasably attached and a second end (6), and that the burner channel (2) extends inside the fluid cooled copper block (3) from the first end (5) to the second end (6).

17 Claims, 5 Drawing Sheets

(56) References Cited

U.S. PATENT DOCUMENTS

Figure 1:
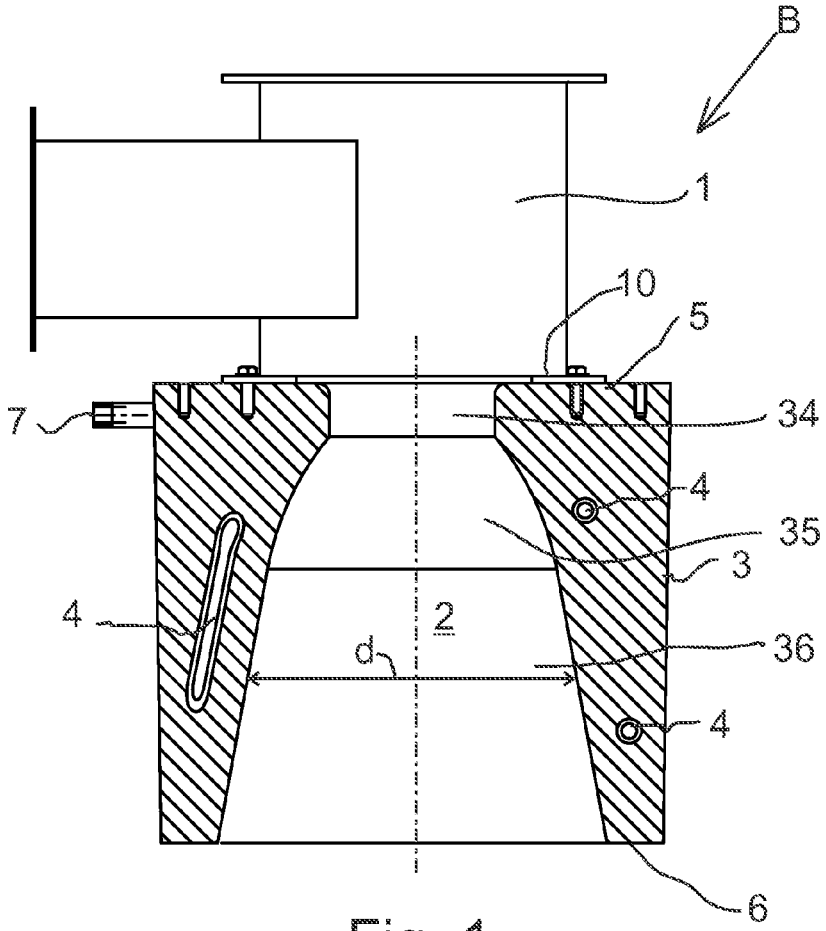

| | | | | |
|---|---|---|---|---|
| 7,497,682 | B2 * | 3/2009 | Kaczenski | F23C 6/045 110/345 |
| 2009/0017409 | A1 | 1/2009 | Santala et al. | |

FOREIGN PATENT DOCUMENTS

| | | | |
|---|---|---|---|
| WO | 01/60123 | A1 | 8/2001 |
| WO | 2007/104828 | A1 | 9/2007 |

* cited by examiner

BURNER ARRANGEMENT AND BURNER ASSEMBLY

CROSS-REFERENCE TO RELATED APPLICATION

This is a national stage application filed under 35 USC 371 based on International Application No. PCT/FI2011/050502 filed May 31, 2011.

The invention relates to a burner arrangement comprising a fluid cooled copper block. Further, the invention relates to a burner assembly, a duct element, a gas circulating duct, and a metallurgical furnace comprising the burner arrangement according to the invention.

A burner is a device to generate a flame to heat up material by combustion of gaseous, liquid or pulverous fuel.

In metallurgical processes burners are used in several different applications, e.g. in gas circulating ducts to provide additional heat to circulating process gas (e.g. US 2009/017409), and in electric arc furnaces as auxiliary heaters to heat and melt metal (e.g. U.S. Pat. No. 6,614,831).

A typical burner arrangement comprises a burner for providing a flame, and an elongated burner channel in close proximity to the burner. The burner channel is configured to form a combustion space and to guide the flame.

US2009/017409 relates to equipment wherein the burner unit is attached directly to the wall of a gas channel and an opening in the refractory wall of the gas channel forms the burner channel.

A problem with this burner arrangement is that the attachment of the burner unit may loosen because the refractory material forming the burner channel tends to deteriorate by cracking due to thermal stresses and/or erosion. Further, erosion of the burner channel weakens its ability to guide the flame into a predetermined direction and to protect the burner unit. It has been tried to solve this problem by providing a cooling coil inside the refractory material defining/forming the burner channel. This arrangement has improved the durability of the burner channel. However, in some installations this is not sufficient. The deterioration of the refractory material of the burner channel may result in damaging the cooling coil which in turn may cause leaking of cooling fluid. Water is usually used as cooling fluid, and leaking of water may cause water-gas explosion inside the furnace. The erosion of the burner channel also weakens its ability to guide the flame into a predetermined direction and to protect the burner unit.

US2009/017409 further relates to a burner unit including a supporting structure that can be fitted as part of the wall of the gas channel. The maintenance of the deteriorated supporting structure requires that the sintering process is interrupted to be able to replace the damaged supporting structure which is a relatively large and heavy part of the gas channel. This causes a relatively long downtime.

U.S. Pat. No. 6,614,831 relates to a burner arrangement for the use in melting furnaces. The burner unit is installed in a fluid-cooled mounting block. The arrangement does not include a burner channel in close proximity to the burner unit and, therefore, the burner unit might get damaged due to blow-back of the flame. Blow-back of the flame to the burner unit may occur if the burner unit is fired at high rates against large pieces of metal scrap that is to be melted in the furnace.

It is an object of the invention to overcome the disadvantages of the prior art as outlined above.

A first aspect of the invention relates to a burner arrangement comprising a burner unit for providing a flame, and an elongated burner channel in close proximity to the burner unit, the burner channel forming a combustion space being configured to protect the flame and the burner unit. According to the invention the burner arrangement comprises a fluid cooled copper block, preferably a water cooled copper block, including a cooling conduit for circulation of the cooling fluid, preferably water, a first end to which the burner unit is releasably attached, and a second end, and the burner channel extends inside the fluid cooled copper block from the first end to the second end.

A second aspect of the invention relates to a burner assembly comprising the burner arrangement according to the invention and a refractory structure which is made of castable refractory material and to which the burner arrangement is connected, preferably releasably connected.

In one embodiment, the burner assembly comprises a burner arrangement according to the invention including a burner unit for providing a flame, and an elongated burner channel in close proximity to the burner unit, said burner channel forming a combustion space being configured to protect the flame and the burner unit, and a refractory structure which is made of castable refractory material and to which the burner arrangement is connected, characterised in that the burner arrangement comprises a fluid cooled copper block including a cooling conduit for circulation of the cooling fluid, a first end to which the burner is releasably attached, and a second end, and that the burner channel extends inside the fluid cooled copper block from the first end to the second end.

In one embodiment of the burner arrangement and burner assembly, the diameter of the burner channel increases in the direction to the second end. For example, if the burner arrangement is installed in a gas duct of a strand sintering furnace or steel belt sintering furnace, as the diameter of the burner channel increases in the direction to the gas circulating duct the diameter of the burner channel decreases in the direction to the burner unit. This provides protection of the burner flame from the gas flowing in the duct.

In one embodiment of the burner arrangement and burner assembly, the cross section of the burner channel is circular.

In one embodiment of the burner arrangement and burner assembly, the cooling conduit has an inlet for introducing the cooling fluid to the cooling conduit, and an outlet for exiting of the cooling fluid from the cooling conduit, said inlet and outlet are located at the outer periphery of the copper block adjacent to the first end, and a coil section extending between the inlet and the outlet, said coil section being arranged to surround the burner channel.

In one embodiment of the burner arrangement and burner assembly, the burner unit comprises a connecting flange to attach the burner unit to the first end of the fluid cooled copper block through a bolted joint.

In one embodiment of the burner arrangement and burner assembly, the burner arrangement comprises a tubular mounting sleeve, which is preferably made of metal such as steel or mild steel, wherein the tubular mounting sleeve comprises anchor elements on the outer surface of the tubular mounting sleeve for anchoring the tubular mounting sleeve in a castable refractory material, and that the tubular mounting sleeve is adapted to receive the fluid cooled copper block inside the tubular mounting sleeve.

In one embodiment of the burner arrangement and burner assembly, the outer surface of the fluid cooled copper block is slightly conical because the outer surface of the copper block converges in the direction to the second end, i.e. its outer diameter decreases in the direction to the second end.

In one embodiment of the burner arrangement and burner assembly, the inner surface of the tubular mounting sleeve has a conical shape corresponding to the shape of the outer surface of the copper block.

In one embodiment of the burner arrangement and burner assembly, the burner arrangement further comprises a ring-like connecting element for attaching the fluid cooled copper block to the tubular mounting sleeve.

In one embodiment of the burner arrangement and burner assembly, the ring-like connecting element comprises a first flange to attach the ring-like connecting element to the first end of the copper block through a bolted joint and a second flange to attach the ring-like connecting element to the mounting sleeve through a bolted joint.

In one embodiment of the burner assembly, the burner assembly comprises a tubular mounting sleeve which is preferably made of metal such as steel or mild steel provided with anchor elements on the outer surface of the tubular mounting sleeve for anchoring the mounting sleeve to the castable refractory structure, and the tubular mounting sleeve is adapted to receive the fluid cooled copper block inside the tubular mounting sleeve.

In one embodiment of the burner assembly, the burner arrangement further comprises a ring-like connecting element for attaching the fluid cooled copper block to the tubular mounting sleeve.

In one embodiment of the burner assembly, the refractory structure is a part of a channel wall of a gas duct, such as a wall of a gas circulating duct of a strand sintering furnace or steel belt sintering furnace.

In one embodiment of the burner assembly, the refractory structure is a refractory wall, or part of a refractory wall, of a metallurgical furnace, such as an electric arc furnace.

A third aspect of the invention relates to a duct element. The duct element according to the invention comprises a burner assembly according to the invention, wherein the refractory structure is a refractory block having a wall made of refractory material, preferably castable refractory material, said wall including a mounting sleeve for the burner arrangement, and complementary sector element which is releasably attached to the refractory block to form a tubular or ring-like structure together with the refractory block.

In one embodiment of the duct element, the refractory block comprises first connecting means for connecting the refractory block to the complementary sector element and second connecting means for connecting the refractory block to adjacent elements of a duct.

In one embodiment of the duct element, the complementary sector element comprises third connecting means for connecting the complementary sector element to the first connecting means of the refractory block, and fourth connecting means for connecting the complementary sector element to adjacent elements of the gas circulating duct.

In one embodiment of the duct element, the first connecting means, the second connecting means, third connecting means and/or the fourth connecting means comprise flanges provided with bolt holes to attach the refractory block and the complementary sector element to each other and to the adjacent elements of the duct through bolted joints.

A fourth aspect of the invention relates to a gas circulating duct, preferably a gas circulating duct of a strand sintering furnace, preferably a steel belt sintering furnace, comprising a burner arrangement according to the invention, a burner assembly according to the invention, or a duct element according to the invention.

A fifth aspect of the invention relates to a metallurgical furnace comprising a burner arrangement according to the invention, a burner assembly according to the invention, a duct element according to the invention, or a gas circulating duct according to the invention. In case that the metallurgical furnace is a strand sintering furnace or a steel belt sintering furnace, it may contain a burner arrangement, a burner assembly, a duct element or a gas circulating duct. In case that the metallurgical furnace is a melting furnace, such as an electric arc furnace, it may contain a burner arrangement or a burner assembly, but it preferably does not contain a duct element or a gas circulating duct.

Another embodiment of the invention relates to a metallurgical furnace comprising the burner arrangement in the burner assembly according to the invention.

A sixth aspect of the invention relates to a method for maintenance of the burner arrangement. The method comprises a step of detaching the burner unit from the fluid cooled copper block.

Another embodiment of the invention relates to a method for maintenance of a burner arrangement in a burner assembly according to the invention. The method comprises steps of removing the burner arrangement by pulling the fluid cooled copper block out from the mounting sleeve, and installing a new burner arrangement by inserting the fluid cooled copper block into the mounting sleeve.

Another embodiment of the invention relates to a method for maintenance of a gas circulating duct according to the invention to replace the burner unit. The method comprises the steps a) detaching the refractory block from the complementary sector element and from the gas circulating duct, wherein the burner arrangement is attached to said refractory block, and
b) detaching the burner unit to be replaced from the fluid cooled copper block which is still attached to the refractory block, and attaching a new burner unit to the cooled copper block, or
c) detaching the burner arrangement in which the burner unit and the fluid cooled copper block are connected to each other from the fluid cooled copper block, and detaching the burner unit from the fluid cooled copper block, and attaching a new burner unit to the cooled copper block, and
d) attaching the refractory block having the burner arrangement attached therein to the complementary sector element and to the gas circulating duct.

Another embodiment of the invention relates to a method for maintenance of a gas circulating duct according to the invention to replace the refractory block. The method comprises the steps e) detaching the refractory block to be replaced from the complementary sector element and from the gas circulating duct, wherein the burner arrangement is attached to said refractory block,
f) detaching the burner arrangement from the refractory block to be replaced, and attaching the burner arrangement to a new refractory block, and
g) attaching the refractory block to the complementary sector element and to the gas circulating duct, wherein the burner arrangement is attached to the refractory block.

Another embodiment of the invention relates to a method for maintenance of a gas circulating duct according to the invention to replace the complementary sector element. The method comprises steps h) detaching the refractory block having the burner arrangement attached therein from the complementary sector element and from the gas circulating duct, i) detaching the complementary sector element to be replaced from the gas circulating duct, j) attaching a new complementary sector element to the gas circulating duct, and k) attaching the refractory block having the burner arrangement attached therein to the complementary sector element and to the gas circulating duct.

The invention provides many advantages. If the refractory around the burner opening is deteriorating, e.g. due to erosion or thermal stress, the fluid cooled copper block would not be damaged and optimal flow of the flame would be ensured. Thereby, the performance of the burner unit is ensured. The fluid cooled copper block is removable and, thus, there is no need to remove parts or a large block of the surrounding refractory material for maintenance. This will reduce maintenance downtime. A more uniform temperature profile is achieved in the refractory material as compared to having steel coils inside the refractory material because the fluid cooled copper block is surrounded by a tubular mounting sleeve. Further, damage to the cooling conduit is less likely to occur because the cooling conduit is located inside the fluid cooled copper block and the copper is surrounded by a metal sleeve, preferably a steel sleeve or mild-steel sleeve, hence, protecting the cooling conduit. The burner unit is located at the first end of the fluid cooled copper block, so that the burner flame is not interfered with by gas travelling in the gas duct. In case the burner arrangement is installed in the side wall of a melting furnace, the fluid cooled copper block with the burner channel protects the burner unit from flame blow-back. Further, replacement of the burner unit and/or the fluid cooled copper block is facilitated.

For the purpose of this description, the terms "refractory material" and "castable refractory material" stand preferably for refractory cement or refractory cement castable such as alumina low cement castable, more preferably alumina low cement castable comprising steel fibres or low cement alumina silica castable comprising steel fibres.

The accompanying drawings, which are included to provide a better understanding of the invention constitute part of the description, illustrate preferred embodiments of the invention and help to explain the principles of the invention.

Figure 2:
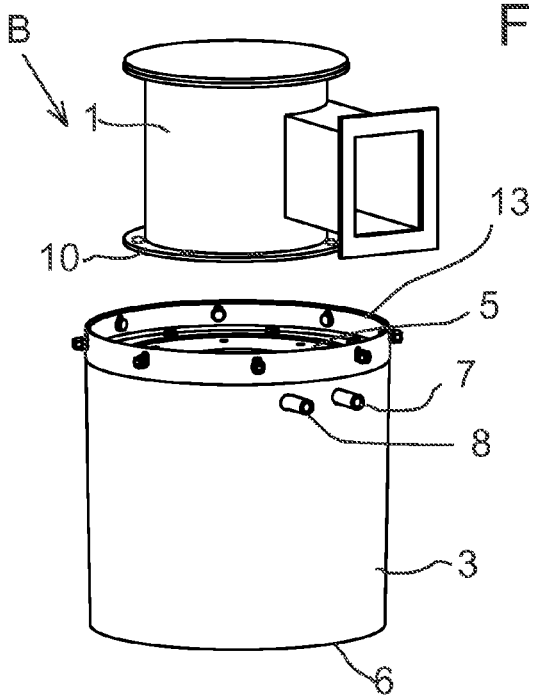
Figure 3:
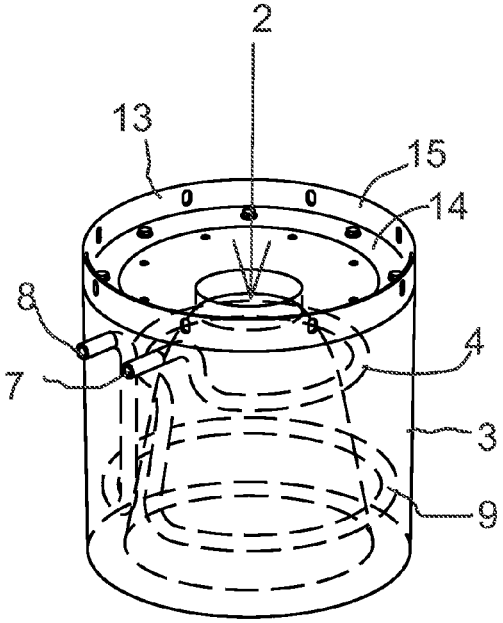
Figure 4:
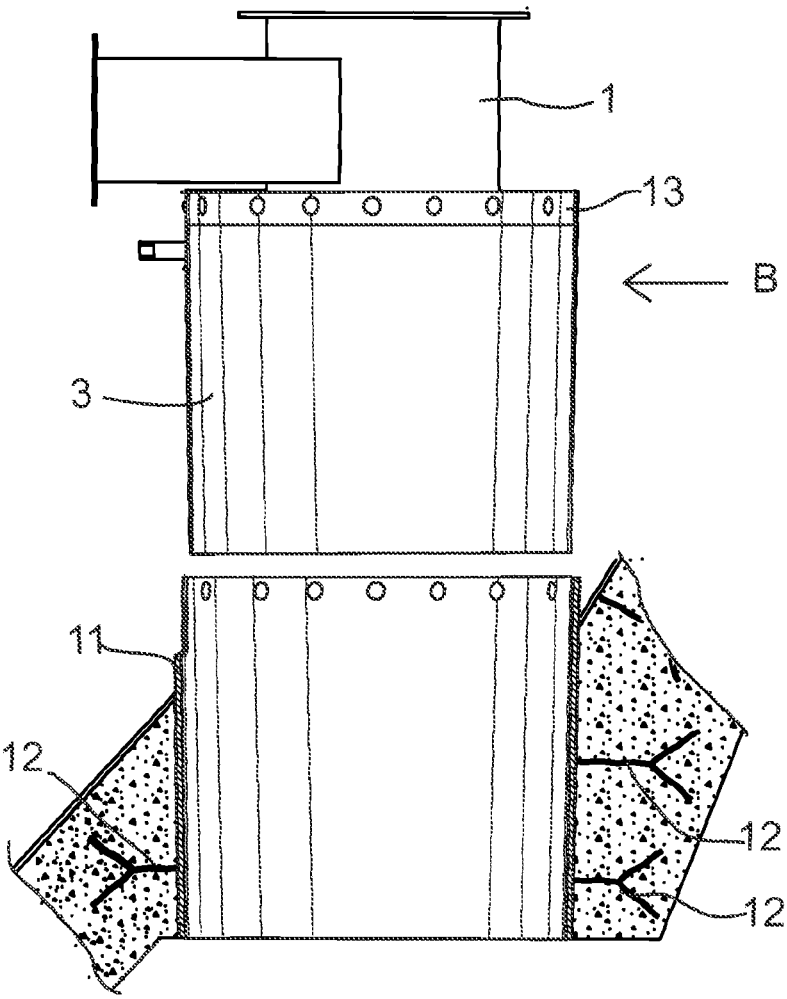
Figure 5:
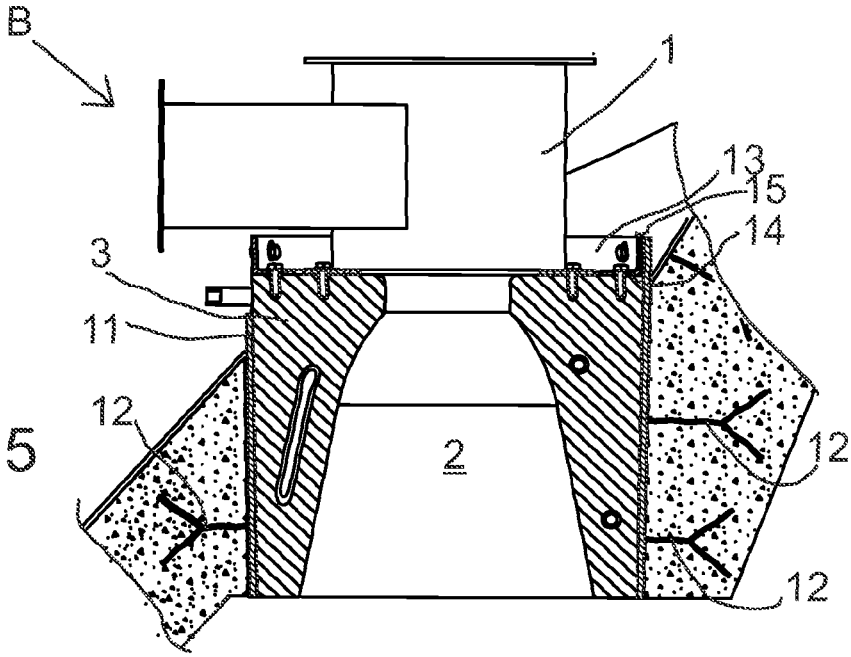
Figure 6:
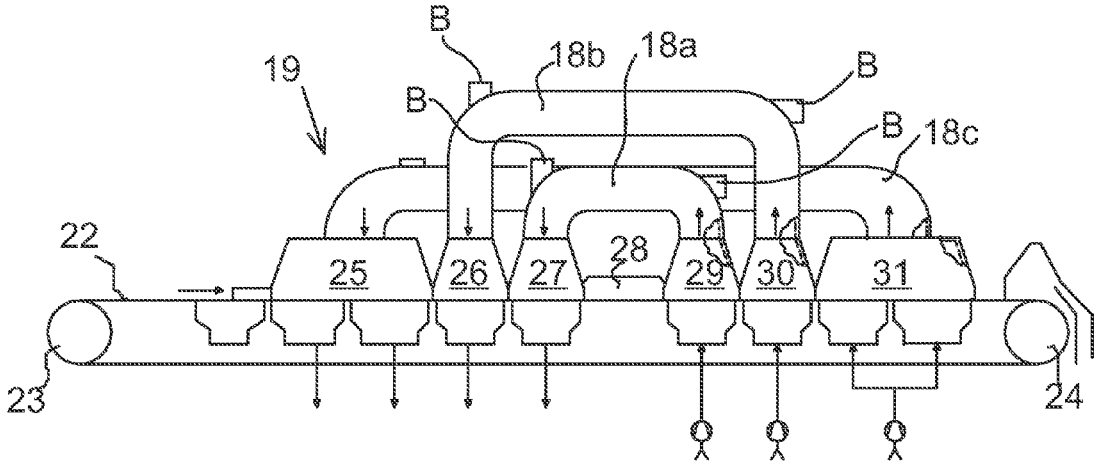
Figure 7:
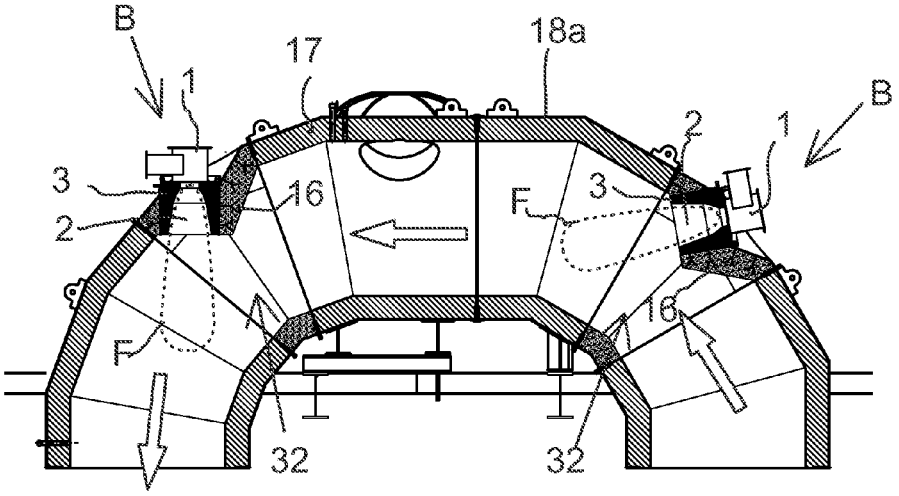
Figure 8:
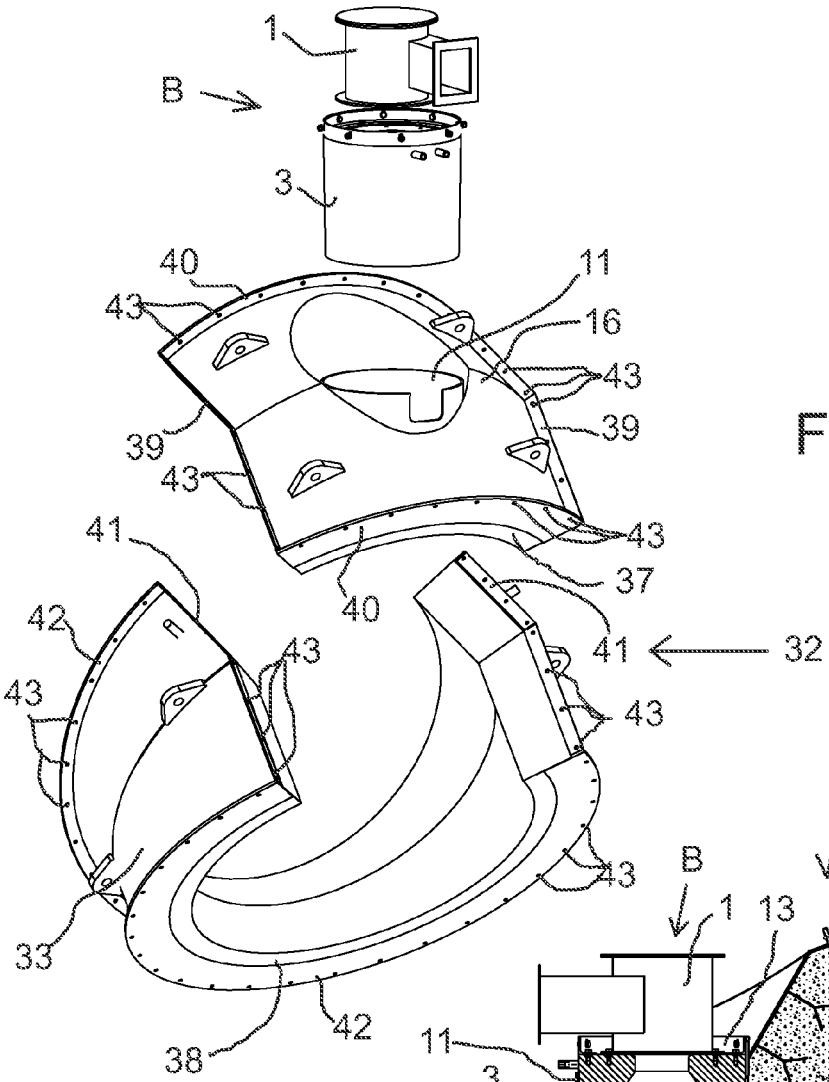
Figure 9:
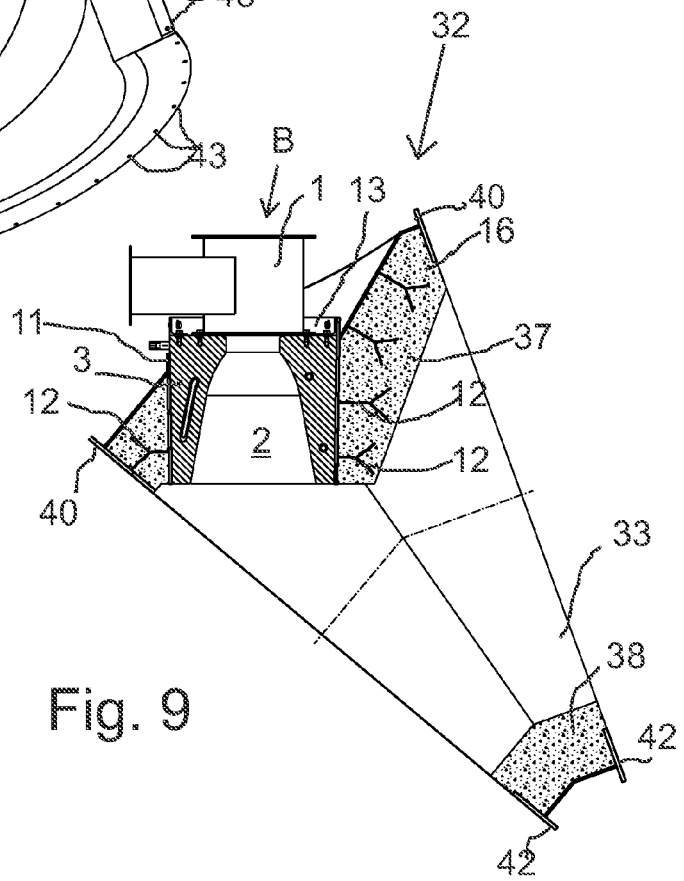
Figure 10:
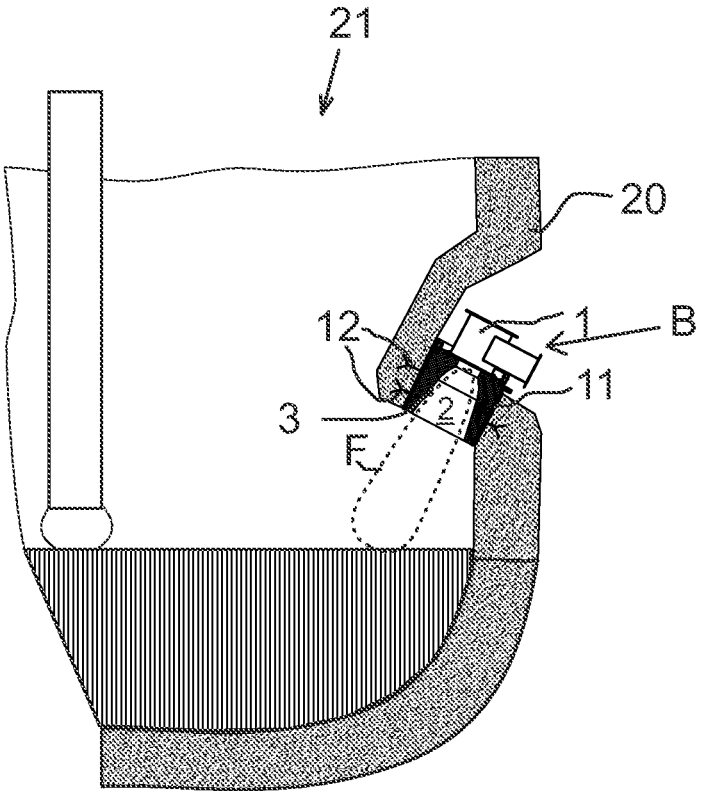

FIG. 1 shows one embodiment of a gas burner arrangement according to one embodiment of the invention, with the fluid cooled copper block shown in cross section, FIG. 2 is an axonometric exploded view of the burner arrangement of FIG. 1 containing the ring-like connecting element, FIG. 3 is an axonometric transparent view of the copper block of FIG. 2, showing the spatial arrangement of the cooling conduit with respect to the burner channel, FIG. 4 is an exploded view of the burner assembly according to one embodiment of the invention, wherein the refractory structure and the tubular mounting sleeve are shown in cross section, FIG. 5 shows the burner assembly of FIG. 4 wherein the burner arrangement is installed into the tubular mounting sleeve, FIG. 6 is a schematic illustration of a strand sintering furnace, preferably a steel belt sintering furnace, which comprises gas circulating ducts, FIG. 7 shows one gas circulating duct including the burner assembly according to one embodiment of the invention, FIG. 8 is an exploded view of a corner section of the gas circulating duct of FIG. 7, the corner section including a refractory block for installation of the burner arrangement, FIG. 9 shows a cross section of the corner section of FIG. 8, and FIG. 10 is a schematic illustration of an electric arc furnace including a burner assembly according to the invention.

Referring to FIGS. 1 to 3, the burner arrangement comprises a burner unit 1 to mix fuel and oxidiser, such as air, to a mixture which is ignited to provide a flame. The burner arrangement comprises an elongated burner channel 2 which is in close proximity to the burner unit 1. The burner channel 2 forms a combustion space and is configured to protect the flame and the burner unit 1. The burner arrangement comprises a fluid cooled copper block 3. The burner unit 1 is releasably attached to the first end 5 of the fluid cooled copper block 3 to facilitate installation and replacement. The fluid cooled copper block 3 contains a cooling conduit 4 through which a continuous circulation of the cooling fluid, preferably water, can be conveyed to cool the fluid cooled copper block 3. The cooling conduit 4 is inside the casted copper of the copper block 3. The burner channel 2 which is a through-hole extends inside the fluid cooled copper block 3 from the first end 5 to the second end 6. The first end 5 and the second end 6 are parallel. The burner channel 2 forms a combustion space which guides the flame and protects the burner unit 1.

As shown in FIG. 1, diameter d of the burner channel 2 increases from the first end 5 in the direction to the second end 6. The inner surface of the burner channel 2 comprises a short surface part 34 adjacent to the first end 5, the diameter of the short surface part 34 increasing in the direction of the first end 5. The short conical surface part 34 continues towards the second end 6 as a round dome surface part 35. The round dome surface part 35 continues to the second end 6 as a conical surface part 36. The cross section of the burner channel 2 is circular. Hence, the cross sections of the cylindrical surface part 34, the round dome surface part 35 and the conical surface part 36 are circular.

Referring to FIG. 3, the cooling conduit 4 has an inlet 7 for introducing the cooling fluid to the cooling conduit 4. The cooling conduit 4 has an outlet 8 for exiting of the cooling fluid from the cooling conduit 4. The inlet 7 and outlet 8 both protrude from the outer periphery of the fluid cooled copper block 3 and are located adjacent to the first end 5. A coil section 9 extends between the inlet 7 and the outlet 8. The coil section 9 is spatially arranged to surround the burner channel 2.

Referring to FIGS. 1 and 2, the burner unit 1 comprises a connecting flange 10 to attach the burner unit 1 to the first end 5 of the fluid cooled copper block 3 through a bolted joint.

With reference to FIGS. 3 and 5 the burner arrangement comprises a tubular mounting sleeve 11 which is preferably made of metal such as steel or mild steel. The tubular mounting sleeve 11 comprises anchor elements 12 on the outer surface of the mounting sleeve 11 for anchoring the mounting sleeve to a castable refractory material. The tubular mounting sleeve 11 is dimensioned to receive the fluid cooled copper block 3 inside its inner space. The outer surface of the fluid cooled copper block 3 is slightly conical so that its outer surface converges in the direction to the second end 6; i.e. its diameter decreases in the direction to the second end 6. The inner surface of the tubular mounting sleeve 11 has a conical shape which is complementary to the outer shape of the fluid cooled copper block 3 so that the fluid cooled copper block 3 fits sufficiently tightly inside the tubular mounting sleeve 11 and can easily be removed.

Referring to FIGS. 2 to 5, the burner arrangement further comprises a ring-like connecting element 13 for attaching the fluid cooled copper block 3 to the tubular mounting sleeve 11. The ring-like connecting element 13 comprises a first flange 14 to attach the ring-like connecting element to the first end 5 of the copper block 3 through a bolted joint, and a second flange 15 to attach the ring-like connecting element to the mounting sleeve 11 through a bolted joint.

Referring to FIG. 4, for maintenance of the burner arrangement B, after the bolted joint between the tubular mounting sleeve 11 and the ring-like connection element 13 has been released, the burner arrangement B can be removed by simply pulling the fluid cooled copper block 3 out from the mounting sleeve 11. A new burner arrangement B can then be installed by inserting the fluid cooled copper block 3 into the tubular mounting sleeve 11 and attaching the ring-like connection element 13 to the mounting sleeve 11 through a bolted joint.

Referring to FIGS. 6 to 9, there is shown one embodiment of the burner assembly according to the invention in a gas circulating duct 18*a*, 18*b* of the strand sintering furnace 19, preferably a steel belt sintering furnace 19, of FIG. 6. The strand sintering furnace or steel belt sintering furnace 19 comprises a strand 22 or steel belt 22, which turns around cylinders 23, 24 (e.g. elevating wheels) that are at its ends, to form an endless conveyor belt. The sintering furnace 19 comprises gas circulating ducts 18*a*, 18*b*, 18*c*, where the gas circulates within the different zones of the sintering furnace. Closed gas cycles are applied in continuous sintering, and the circulating gas is exploited in the various zones of the process. The material to be sintered is supplied to the strand 22 or steel belt 22 to form a bed on its upper surface. In the furnace, the material to be sintered first travels through a drying zone 25 and a pre-heating zone 26, moving then to a sintering zone 27 that has one or several sections. After the sintering zone 27, the equipment usually comprises a stabilising zone 28, after which there is a cooling zone containing several stages 29, 30 and 31. Gas is introduced to the sintering equipment, first, to the various stages 29, 30, 31 of the cooling zone. The arrows shown in FIG. 6 indicate the direction of the gas flow in the gas circulating ducts 18*a*, 18*b* and 18*c*. After the gas has travelled through the strand 22 or steel belt 22 and the bed of material to be sintered, which is on the upper surface of the same, the gas is sucked from each of the stages 29, 30 and 31 into the respective gas circulating duct 18*a*, 18*b*, 18*c*. The gas that is to be removed from the outermost gas channel 18*c* (as viewed in the flow direction of the material to be sintered) is directed to the drying zone 25, and this gas circulating duct 18*c* is generally not provided with burner units. Instead, the gas from the cooling stages 29 and 30 located nearer to the middle part of the strand sintering furnace 19 or steel belt sintering furnace 19 is directed to the gas circulating ducts 18*a* and 18*b*, which are provided with burner units 1. The inner part of the gas circulating ducts 18*a*, 18*b* is made of castable refractory material. The sintered material is removed from the strand 22 or steel belt 22 for further processing. The gases are removed from the sintering zone 27, pre-heating zone 26 and drying zone 25 to gas cleaning and possibly recycled back to the sintering process.

FIG. 7 shows a gas circulating duct 18*a* of FIG. 6 equipped with two burner arrangements B of FIGS. 1 to 3 which are installed in a refractory block 16 according to the principles as already depicted with reference to FIGS. 4 and 5.

The refractory block 16 forms a part of the duct wall 17 of the gas circulating duct 18*a*. The arrows show the direction of the gas flow. The burner arrangements B are arranged so that the burner channels 2 of the fluid cooled copper block 3 direct the flame F substantially to the direction of the gas flow in the gas circulating duct 18*a*. Due to the angled arrangement of the burner arrangements B the burner unit 1 and burner channel 2 are well protected from the influences of the gas flow. FIGS. 8 and 9 show a duct element 32 of FIG. 7. The duct element 32 comprises a refractory block 16 having a wall made of refractory material 37. The refractory wall 37 of the refractory block 16 includes a tubular mounting sleeve 11 for attaching the burner arrangement B to the refractory block 16. The tubular mounting sleeve 11 comprises anchor elements 12 on the outer surface of the mounting sleeve 11 for anchoring the mounting sleeve to a castable refractory material of the refractory block 16. The duct element 32 further comprises a complementary sector element 33 having a wall made of refractory material 38. The complementary sector element 33 when attached to the refractory block 16 forms a tubular or ring-like structure together with the refractory block 16.

The refractory block 16 comprises first connecting means 39 for connecting the refractory block 16 to the complementary sector element 33 and second connecting means 40 for connecting the refractory block 16 to adjacent elements of the gas circulating duct 18*a*, 18*b*. The complementary sector element 33 comprises third connecting means 41 for connecting the complementary sector element 33 to the first connecting means 39 of the refractory block 16, and fourth connecting means 42 for connecting the complementary sector element 33 to adjacent elements of the gas circulating duct 18*a*, 18*b*. The first connecting means 39 comprise flanges with bolt holes 43 to attach the refractory block 16 to the complementary sector element 33, preferably through bolted joints. The third connecting means 41 comprise flanges with bolt holes 43 to attach the complementary sector element 33 to the refractory block 16, preferably through bolted joints. The second connecting means 40 comprise flanges with bolt holes 43 to attach the refractory block 16 to the adjacent elements of the gas circulating duct 18*a*, 18*b*, preferably through bolted joints. The fourth connecting means 42 comprise flanges with bolt holes 43 to attach the complementary sector element 33 to the adjacent elements of the gas circulating duct 18*a*, 18*b*, preferably through bolted joints.

For maintenance of a gas circulating duct 18*a*, to replace the burner unit 1, the refractory block 16 having the burner arrangement B attached therein is detached from the complementary sector element 33 and from the gas circulating duct 18*a*, 18*b*. Thereafter, the burner unit 1 to be replaced is detached from the fluid cooled copper block 3 which remains attached to the refractory block 16. A new burner unit 1 can then be attached to the cooled copper block 3. Alternatively, the burner arrangement B in which the burner unit 1 and the fluid cooled copper block 3 are connected to each other as an assembly can be detached from the refractory block 16 and thereafter the burner unit 1 is detached from the fluid cooled copper block 3, and a new burner unit 1 is attached to the cooled copper block 3. Finally, the refractory block 16 having the burner arrangement B attached therein can be attached to the complementary sector element 33 and to the gas circulating duct 18*a*, 18*b*.

For maintenance of a gas circulating duct 18*a*, to replace the refractory block 16, the refractory block 16 to be replaced having the burner arrangement B attached therein is detached from the complementary sector element 33 and from the gas circulating duct 18*a*, 18*b*. Thereafter, the burner arrangement B is detached from the refractory block 16. The burner arrangement B is attached to a new refractory block 16. Finally, g the refractory block 16 having the burner arrangement B attached therein is attached to the complementary sector element 33 and to the gas circulating duct 18*a*, 18*b*.

For maintenance of a gas circulating duct 18*a*, to replace the refractory block 16, to replace the complementary sector element 33, the refractory block 16 having the burner arrangement B attached therein is detached from the complementary sector element 33 and from the gas circulating duct 18*a*, 18*b*. The complementary sector element 33 to be replaced is detached from the gas circulating duct 18*a*, 18*b*. A new complementary sector element 33 is attached to the gas circulating duct 18*a*, 18*b*. Finally, the refractory block 16 having the burner arrangement B attached therein is attached to the complementary sector element 33) and to the gas circulating duct 18*a*, 18*b*.

FIG. 10 shows a metallurgical furnace 22 equipped with a burner arrangement B of FIGS. 1 to 3 which is installed in the refractory wall 20 of an electric arc furnace 21 according to the principles as already depicted with reference to FIGS. 4 and 5.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A burner arrangement comprising a burner unit for providing a flame, and an elongated burner channel in close proximity to the burner unit, the burner channel forming a combustion space being configured to protect the flame and the burner unit, a fluid cooled copper block including a cooling conduit for circulation of the cooling fluid, the cooling conduit being inside the casted copper of the copper block, a first end of the burner channel to which the burner unit is releasably attached, and a second end of the burner channel, the burner channel extending inside the fluid cooled copper block from the first end to the second end, where the burner arrangement comprises a tubular mounting sleeve comprising anchor elements on the outer surface of the tubular mounting sleeve for anchoring the tubular mounting sleeve to a castable refractory material, where the tubular mounting sleeve is adapted to receive the fluid cooled cooper block inside the tubular mounting sleeve, where the outer surface of the fluid cooled copper block is conical so that its outer diameter decreases towards the second end, and where the inner surface of the mounting sleeve has a conical shape corresponding to the shape of the outer surface of the fluid cooled copper block.

2. The burner arrangement according to claim 1, characterized in that the burner channel has a diameter that increases in the direction to the second end.

3. The burner arrangement according to claim 1, characterized in that the burner channel has a cross section that is circular.

4. The burner arrangement according to claim 1, characterized in that the cooling conduit has an inlet for introducing the cooling fluid to the cooling conduit, and an outlet for exiting of the cooling fluid from the cooling conduit, wherein the inlet and outlet are located at the outer periphery of the fluid cooled copper block adjacent to the first end, and a coil section extending between the inlet and the outlet, the coil section being arranged to surround the burner channel.

5. The burner arrangement according to claim 1, characterized in that the burner unit comprises a connecting flange to attach the burner unit to the first end of the fluid cooled copper block through a bolted joint.

6. The burner arrangement according to claim 1, characterized in that the burner arrangement further comprises a ring-like connecting element for the attachment of the fluid cooled copper block to the mounting sleeve.

7. The burner arrangement according to claim 6, characterized in that the ring-like connecting element comprises a first flange to attach the ring-like connecting element to the first end of the copper block rough a bolted joint and a second flange to attach the ring-like connecting element to the mounting sleeve through a bolted joint.

8. The burner arrangement according to claim 1, characterized in that the burner arrangement is part of a burner assembly that comprises a refractory structure made of castable refractory material and to which the burner arrangement is connected.

9. The burner arrangement according to claim 8, characterized in that the burner assembly comprises a tubular mounting sleeve, which is preferably made of metal such as steel or mild steel, comprising anchor elements on the outer surface of the tubular mounting sleeve for anchoring the tubular mounting sleeve in the refractory structure, and that the tubular mounting sleeve is adapted to receive the fluid cooled copper block inside the tubular mounting sleeve.

10. The burner arrangement according to claim 8, characterized in that the burner arrangement further comprises a ring-like connecting element for attaching the fluid cooled copper block to the tubular mounting sleeve.

11. The burner arrangement according to claim 8, characterized in that the refractory structure is a refractory block which forms a part of a channel wall of a gas circulating duct.

12. A burner arrangement according to claim 8, in that the burner assembly is associate a duct element wherein the refractory structure is a refractory block having a wall made of refractory materials, the wall including a mounting sleeve for the burner arrangement, and a complementary sector element is releasably attached to the refractory block to form a tubular or ring-like structure together with the refractory block.

13. The burner arrangement according to claim 12, characterized in that the refractory block comprises a first connector that connects the refractory block to the complementary sector element and a second connector that connects the refractory block to adjacent elements of a duct.

14. The burner arrangement according to claim 13, characterized in that the complementary sector element comprises third connecting means for connecting the complementary sector element to the first connecting means of the refractory block, and fourth connecting means for connecting the complementary sector element adjacent elements of the gas circulating duct.

15. The burner arrangement according to claim 14, characterized in that the first connecting means, the second connecting means, third connecting means and/or the forth connecting means comprise flanges provided with bolt holes to attach the refractory block and the complementary sector element to each other and to the adjacent elements of the duct through bolted joints.

16. The burner arrangement according to claim 1, characterized in that the burner arrangement is operatively connected with a gas circulating duct of a strand sintering furnace.

17. The burner arrangement according to claim 1, characterized in that the burner arrangement is operatively connected with metallurgical furnace.

* * * * *